US005435847A

United States Patent [19]

Shibata et al.

[11] Patent Number: 5,435,847

[45] Date of Patent: * Jul. 25, 1995

[54] COATING APPARATUS

[75] Inventors: Norio Shibata; Tsunehiko Sato, both of Kanagawa, Japan

[73] Assignee: Fuji Photo Film Co., Ltd., Kanagawa, Japan

[ * ] Notice: The portion of the term of this patent subsequent to Mar. 31, 2009 has been disclaimed.

[21] Appl. No.: 933,963

[22] Filed: Aug. 24, 1992

Related U.S. Application Data

[63] Continuation-in-part of Ser. No. 571,066, Aug. 23, 1990, abandoned.

[30] Foreign Application Priority Data

Sep. 1, 1989 [JP] Japan ..... 1-224698

[51] Int. Cl.[6] ..... B05C 5/00; B05C 5/02

[52] U.S. Cl. ..... 118/410; 118/419

[58] Field of Search ..... 118/419, 410, DIG. 4, 118/DIG. 2; 427/356; 425/461

[56] References Cited

U.S. PATENT DOCUMENTS 4,299,186 11/1981 Pipkin et al. ..... 118/419 X
4,424,762 1/1984 Tanaka et al. ..... 118/410
4,577,362 3/1986 Tanaka et al. ..... 118/123 X
5,099,786 3/1992 Shibata et al. ..... 118/410
5,105,760 4/1992 Takahashi et al. ..... 118/410
5,167,712 12/1992 Shibata et al. ..... 118/410

*Primary Examiner*—Brenda Adele Lamb
*Attorney, Agent, or Firm*—Sughrue, Mion, Zinn, Macpeak & Seas

[57] ABSTRACT

An extrusion type coating apparatus having a coating head with a back edge end face and a doctor edge end face set close to a flexible support which is continuously run and with which a coating solution is applied to the flexible support. The inner edge of each of a pair of coating width regulating members made of metal and which are arranged in the slot of the coating head at respective ends thereof, are formed to have a radius of curvature of 0.5 mm or less, and the downstream edge of the end face of each coating width regulating member is continuous with the upstream edge of the doctor edge end face, while the upstream edge of the end face of each coating width regulating member is abutted against the inner wall of a back edge forming the coating head with the distance between the slot forming edge of the back edge end face and the upstream edge of the end face of the coating width regulating member set to half or less of the gap width of the slot.

2 Claims, 2 Drawing Sheets

COATING APPARATUS

This is a continuation-in-part of application Ser. No. 07/571,066, filed Aug. 23, 1990 now abandoned.

BACKGROUND OF THE INVENTION

The present invention relates to a coating apparatus for coating a flexible support made of plastic film, paper, metal foil or the like (hereinafter referred to as "a web" when applicable) with a coating solution such as a photographing photosensitive solution, magnetic solution, surface protective solution or the like.

Examples of a coating apparatus for coating a web with a coating solution include a roll type coating apparatus, bead type coating apparatus, slide coat type coating apparatus, bar coater type coating apparatus, or extrusion type coating apparatus. In each of these coating apparatuses, the widthwise dimension of the apparatus is larger than the width of the web, and the width of the coating part of the apparatus is smaller than the width of the web. As a result, uncoated regions are formed along the two edges of the web. With this arrangement, there is eliminated the difficulties of the coating solution flowing over to the rear side of the web during coating, or, if the web meanders, the coating solution being jetted past the edges of the web.

In the case of a bar coater or extrusion type coating apparatus in which the coating head is held close to the web and the coating solution is applied onto the web from a widthwise-extending slit in the coating head, coating width regulating boards are fitted in the two ends of the slit to prevent the coating solution from moving sideward. (See, for example, Japanese Unexamined Published Patent Application Nos. 257263/1986 and 257268/1986.) This will be described more concretely.

In the case of an extrusion type coating apparatus as shown in FIG. 4, the coating head 22 is larger in width than the web 20 being coated. The coating head 22 has a back edge 24 and a doctor edge 23 between which is defined a slot 26 through which is discharged a coating solution over the web in the widthwise direction. The slot 26 is communicated with a solution pool formed inside the coating head 22. The solution pool has openings at both ends which are closed with shield boards 28 provided at both ends of the coating head 22. A coating solution supplying inlet 27 is formed through one of the shield boards 28, thus supplying the coating solution into the solution pool. The coating solution thus supplied is discharged through the slot 26 under a pressure uniform in the widthwise direction of the slot 26. A pair of coating width regulating boards 25 are fitted in the slot 26 at both ends to determine the coating width and to prevent the coating solution from flowing sidewardly. The coating width of the coating solution applied onto the web 20 can be controlled by adjusting the distance between the coating width regulating boards 25.

The coating width regulating boards 25 are made of a synthetic resin material such as TEFLON (polytetrafluoroethylene) resin so that they can be formed readily and installed accurately. If the coating width regulating boards 25 were made of a metallic material, it would be necessary to polish their end faces and make the boards flush with the end faces of the back edge 24 and the doctor edge 23. It is, however, rather difficult to make the end face of such regulating boards flush with those of the back edge and the doctor edge, and it is also difficult to install the regulating boards with high accuracy.

The coating width regulating boards 25 made of synthetic resin material can be installed accurately due to the fact that they can be cut readily. Resin boards whose thickness is equal to the gap of the slot 26 are selected for formation of the coating width regulating boards. To install the boards, the resin boards thus Selected are fitted in the slot 26 in such a manner that they protrude from the end portions of the slot 26, and then the protrusions are cut along the end faces of the back edge 24 and the doctor edge 23. The resultant end faces of the coating width regulating boards 25 are thus easily made accurately flush with those of the back edge and the doctor edge.

However, when an extrusion type coating head with coating width regulating boards of synthetic resin is used for a long time to coat a web with a coating solution, the border lines between the coated region of the web and the uncoated regions along the edges of the web tend to become wavy, or the coating solution applied to the web becomes thicker along the border lines.

The inventors have conducted intensive research on these problems, and have found that the difficulty is due to the fact that the inner edges of the coating width regulating boards used to regulate the coating width tend to wear during coating or to suffer deformation when the coating head is cleaned, or the end edges of the coating width regulating boards of synthetic resin machined are not sufficiently sharp. In such cases, the coating solution tends to leak at the coating width regulating boards. Furthermore, the inventors have found that, in the case where the web is a resin sheet, dust has a tendency to accumulate on the web due to static electricity generated by the contact of the coating width regulating boards with the part of the web to be coated with the coating solution, the dust thus accumulated pushes up both edge portions of the resin sheet, and thus the thickness of the coated layer in those regions is increased.

Accordingly, an object of the present invention is to eliminate the above-described difficulties accompanying a conventional coating apparatus. More specifically, an object of the invention is to provide a coating apparatus with excellent coating width regulating members capable of forming a coated layer which is free from the difficulties that the coating solution applied onto a web is wavy and not uniform in thickness.

SUMMARY OF THE INVENTION

The foregoing and other objects of the invention have been achieved by the provision of an extrusion type coating apparatus having a coating head with a back edge end face and a doctor edge end face set close to a flexible support which is continuously run and with which a coating solution is applied to the flexible support, in which, according to the invention, the inner edge of each of a pair of coating width regulating members made of a metallic material and which are arranged in the slot of the coating head at respective ends thereof are formed to have a radius of curvature between 0.5 mm and 0.001 mm, the downstream edge of the end face of each coating width regulating member is continuous with the upstream edge of the doctor edge end face, and the upstream edge of the end face of each coating width regulating member is abutted against the inner wall of a back edge forming the coating head with the distance between the slot forming edge of the back edge end face and the upstream edge of the end face of the coating width regulating member set to half or less of the gap of the slot.

DESCRIPTION OF THE PREFERRED EMBODIMENTS

Figure 1:
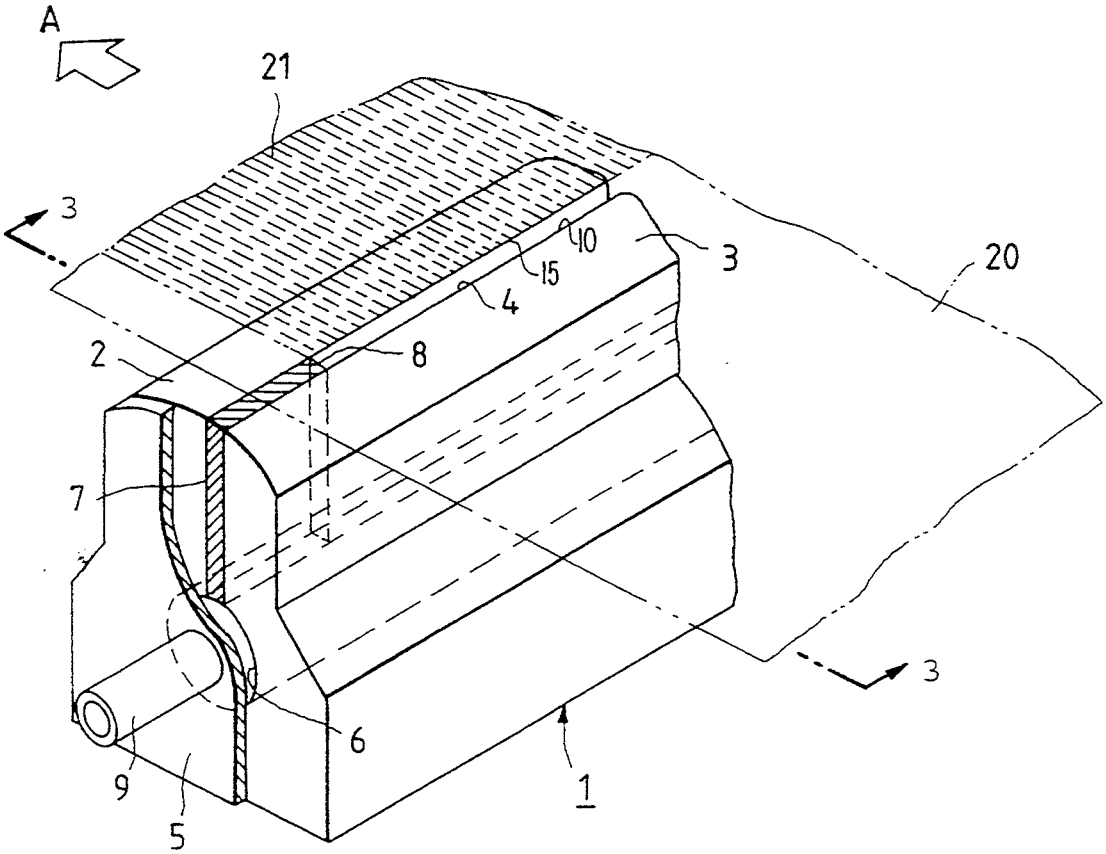
FIG. 1 is a perspective view showing an extrusion type coating head of a coating apparatus constructed in accordance with a preferred embodiment of the invention.

FIG. 1 is a perspective view of an extrusion type coating head 1 in a coating apparatus constructed in accordance with a preferred embodiment of the present invention.

The width of the coating head 1 is larger than the width of a web 20. The coating head 1 includes a doctor edge 2 and a back edge 3 between which is defined a slot 4 through which is discharged a coating solution over the width of the web 20. The doctor edge 2 and the back edge 3 have a doctor edge end face 14 and a back edge end face 13 at their respective ends which are set close to the web 20. The slot 4 is communicated with a solution pool 6 formed inside the coating head 1. The solution pool 6 has openings at both ends which are closed with a pair of shield boards 5. A coating solution supplying inlet 9 through which the coating solution is supplied into the solution pool 6 is formed through one of the shield boards 5. The coating solution thus supplied is discharged through the slot 4 under a pressure uniform in the widthwise direction of the latter. A pair of coating width regulating boards 7 are fitted in the slot 4 at both ends to resist the flow of the coating solution thereby to determine the width of a coated layer 21 formed on the web.

Figure 2:
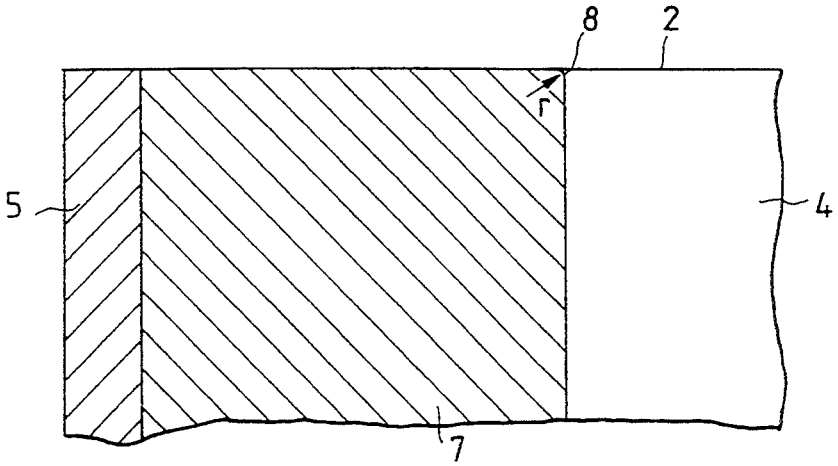
FIG. 2 is a sectional view showing a part of the extrusion type coating head of FIG. 1.

The coating width regulating boards 7 are rectangular plates of cemented carbide material, and their surfaces are polished to less than 1-S (J.I.S. code B 0601) in surface roughness. In particular, the inner edge 8 of each of the coating width regulating boards 7 is polished so that the radius of curvature (r) between 0.5 mm and 0.001 mm (see FIG. 2). If the radius of curvature (r) is less than 0.001 mm., the edge portion may be substantially deformed and/or cause undesirable static electricity.

Figure 3:
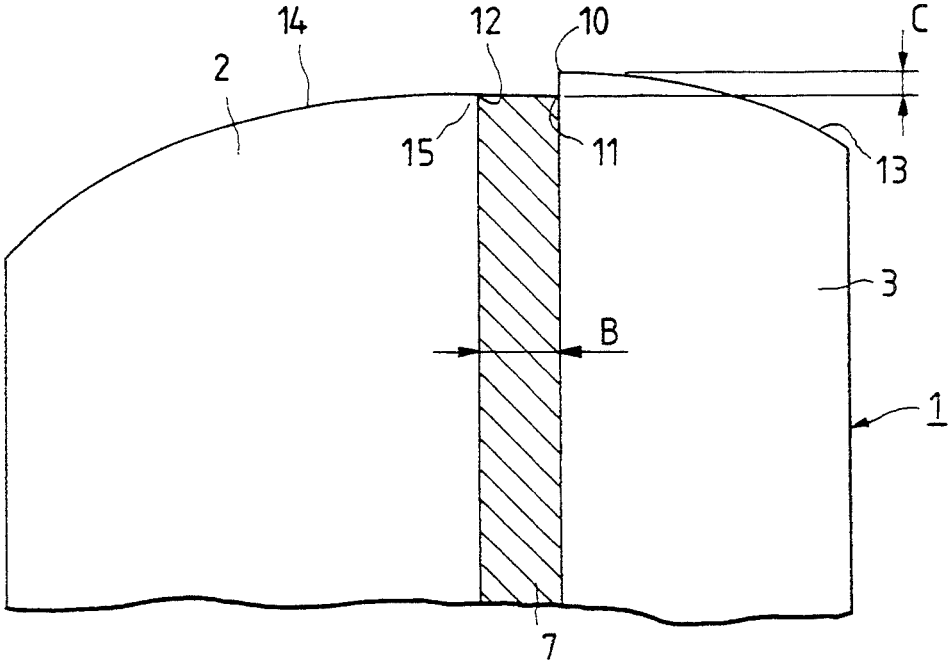
FIG. 3 is a sectional view taken along a line III—III in FIG. 1.
Figure 4:
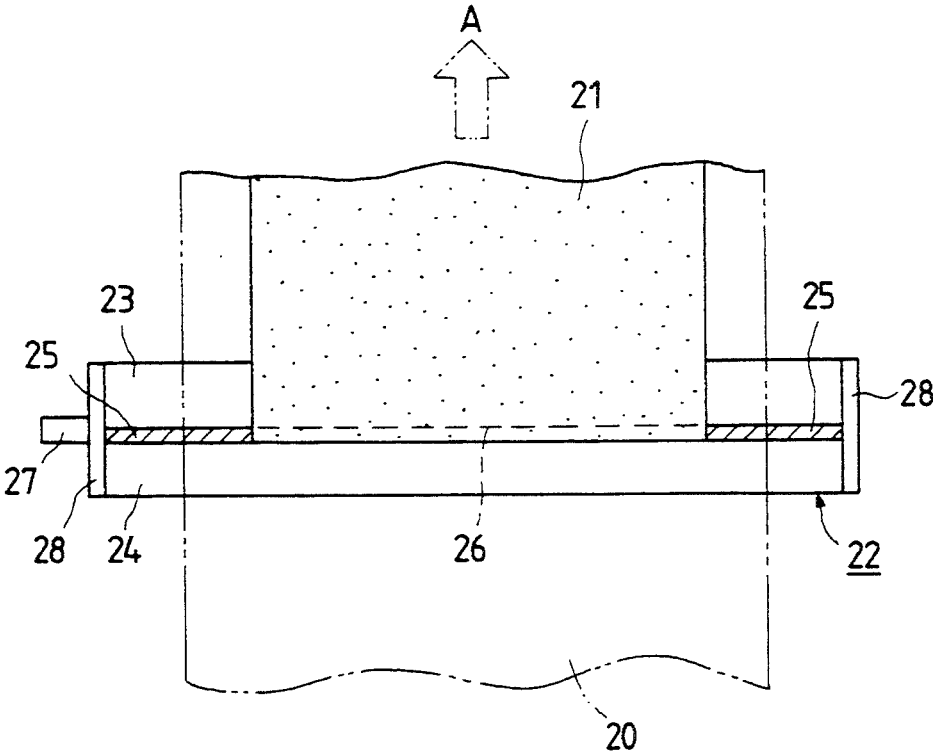
FIG. 4 PRIOR ART
FIG. 4 is a top view of an extrusion type coating head of a conventional coating apparatus.

When the coating width regulating boards 7 are inserted into the slot 4 at both ends as shown in FIG. 3, they are fixedly positioned in such a manner that the downstream edge 12 of the end face of each coating width regulating board 7 meets the upstream edge 15 of the doctor edge end face 14, and the end face of the coating width regulating board 7 is continuous with the doctor edge end face 14. It is not always necessary that the upstream edge 11 of the end face of the coating width regulating board 7 meet the slot forming edge 10 (downstream edge) of the back edge end face 13; that is, all that is necessary for the upstream edge 11 of the end face of the coating width regulating board 7 is that it abut the inner wall of the back edge 3 with the distance C between the upstream edge 11 and the slot forming edge 10 of the back edge 3 being not more than half of the gap width B of the slot 4. That is, it is unnecessary to make the end faces of the coating width regulating boards 7 flush with the back edge end face 13 with high accuracy. Hence, even if the coating width regulating boards 7 are made of a metallic material, the coating head can be fabricated with ease.

Thus, according to the invention, the alignment of the end face of the coating width regulating boards 7 with the back edge end face 13 is simplified, which makes it possible to employ coating width regulating boards 7 made of a metallic material. The edges of the width regulating boards of a metallic material can be much higher in machining accuracy than those the conventional boards made of synthetic resin. Therefore, even if the coating head is used for a long time, the edges of the coating width regulating boards will not wear appreciably and little or no deformation will occur when, for instance, the coating head is cleaned.

As described above, the coating width regulating boards 7 are made of a metallic material, which is of course high in conductivity. Hence, very little static electricity is generated by the contact of the coating width regulating boards with the part of the web which is to be coated with the coating solution, and accordingly the accumulation of dust in the those regions is prevented.

The coating head according to the invention is not limited to that which has been described above; that is, the technical concept of the invention may be applied to a variety of different types of coating heads used to form a coated layer uniform in thickness on a web.

In the extrusion type coating apparatus according to the invention, the inner edges of the coating width regulating members made of a metallic material arranged in the slot of the coating head at both ends thereof is formed to have a radius of curvature of 0.5 mm or less. The end face of the coating head is formed by the back edge end face and the doctor edge end face, and the downstream edge of the end face of each coating width regulating member is continuous with the upstream edge of the doctor edge end face, while the upstream edge of the end face of each coating width regulating member is abutted against the inner wall of a back edge forming the coating head with the distance between the slot forming edge of the back edge end face and the upstream edge of the end face of the coating width regulating member set to half or less of the gap width of the slot.

With this arrangement, the alignment of the end face of the coating width regulating boards with the back edge end face 13 is simplified, which makes it possible to employ coating width regulating boards made of a metallic material. The edges of the width regulating boards made of a metallic material can be much higher in machining accuracy than those the conventional boards made of synthetic resin. Furthermore, the inner edge of each of the coating width regulating members is formed so as to have a radius of curvature of 0.5 mm or less, which eliminates the difficulty that, when the web is coated with the coating solution, the border lines of the coated region and the uncoated regions along both edges of the web become wavy.

In the coating apparatus of the invention, because the coating width regulating boards are made of a metallic material high in electrical conductivity, very little static electricity is generated by the contact of the coating width regulating boards with the uncoated regions of the web. This eliminates the difficulty of dust accumulating on the uncoated regions of the web and pushing both edge portions of the web to thereby make the coated layer nonuniform in thickness.

Thus, the coating apparatus according to the invention has excellent coating width regulating members capable of forming a coated layer which is free from the difficulties of the coating solution applied onto a web being wavy and nonuniform in thickness.

As conducive to a full understanding of the effects of the invention, specific examples thereof will be described.

EXAMPLES OF THE INVENTION

Example 1

A methyl ethyl ketone solution of vinyl chloride-vinyl acetate copolymer (copolymerization ratio 71:29, and polymerization degree 700) was prepared as a coating solution. A plurality of extrusion type coating heads as shown in FIG. 1 were used to form coated layers on the webs. These coating heads had respective slot widths B of 0.1 mm, 0.3 mm, 0.8 mm and 2.0 mm. Coated layers were formed on webs using each of these coating heads.

In each of the coating heads, the radius of curvature of the curved part of the doctor edge end face 14 was 5 mm. The web employed was a polyethylene terephthalate film 15 μm in thickness and 300 mm in width.

The coating width regulating boards 7 to be fitted in the slots 4 of the coating heads were made of cemented carbide, and polished to 1-S or less in surface roughness. The coating width regulating boards 7 fitted in the above-described coating heads were machined to have respective radii of curvature (r) of their inner edges of 0.1 mm, 0.3 mm, 0.5 mm, 0.7 mm and 1.0 mm. In this operation, in each of the coating heads, the end face of the coating width regulating board, the doctor edge end face 14, and the back edge end face 13 were continuous to and flush with one another.

The presence or absence of the wavy border line phenomenon or nonuniform thickness phenomenon, as might occur along the border lines between the two edges in the widthwise direction of the coated layer formed on the web under the coating conditions specified in the following Table 1, were detected, and the results of detection are as indicated in Table 2 below.

TABLE 1

| | |
|---|---|
| Coating solution viscosity | 0.05 to 1 poise with a shear rate of 1000 $sec^{-1}$ |
| Coating rate | 5 to 30 $cc/m^2$ |
| Coating speed | 100 to 800 m/min |
| Coating part tension | 15 to 30 kgw/m |

The coating solution viscosity was adjusted by suitably changing the density of the vinyl chloride-vinyl acetate copolymer.

TABLE 2

| | | Radius of curvature (r) of inner edge of coating width regulating board (mm) | | | | |
|---|---|---|---|---|---|---|
| | | 0.1 | 0.3 | 0.5 | 0.7 | 1.0 |
| Slot distance B (mm) | 0.1 | ○ | ○ | X | X | X |
| | 0.3 | ○ | ○ | ○ | X | X |
| | 0.8 | ○ | ○ | ○ | X | X |
| | 2.0 | ○ | ○ | ○ | X | X |

In Table 2, the mark "O" indicates the case where neither the wavy border line phenomenon nor the nonuniform thickness phenomenon was detected with the coating conditions varied within the ranges specified in Table 1, and the mark "X" indicates the case where the wavy border line phenomenon or nonuniform thickness phenomenon was detected with the coating conditions changed within the ranges specified in Table 1.

Example 2

A methyl ethyl ketone solution of vinyl chloride-vinyl acetate copolymer (copolymerization ratio 71:29, and polymerization degree 700) was prepared as a coating solution. A plurality of extrusion type coating heads as shown in FIG. 1 which were 0.1 mm, 0.3 mm, 0.8 mm and. 2.0 mm in slot gap width B, respectively, were used to form coated layers.

In each of the coating heads, the radius of curvature of the curved part of the doctor edge end face 14 was 5 mm. The web employed was a polyethylene terephthalate film 15 μm in thickness and 300 mm in width.

The coating width regulating boards 7 fitted in the slots 4 of the coating heads were made of cemented carbide, and were polished to 1-S or less in surface roughness. The coating width regulating boards 7 were machined to have inner edges having a radius of curvature (r) of 0.02 mm. In this operation, the coating width regulating boards were set in the coating head with the downstream edge 12 of each of the coating width regulating boards meeting with the upstream edge of the doctor edge end face, and the upstream edges 11 of the coating width regulating board abutting against the inner walls of the back edge with the distances between the slot forming edges 10 of the back edge end faces and the upstream edges 11 set to 1/10, 3/10, ½, 7/10, and 9/10 of the slot distances B described above.

The presence or absence of the wavy border line phenomenon or nonuniform thickness phenomenon was detected along the border lines between the two edges and in the widthwise direction of the coated layer formed on the web for each of the coating heads and the uncoated region of the web. The results of detection are as indicated in Table 3 below.

TABLE 3

| | | Distance C (mm)/Slot distance B (mm) | | | | |
|---|---|---|---|---|---|---|
| | | 1/10 | 3/10 | 1/2 | 7/10 | 9/10 |
| Slot distance B (mm) | 0.1 | ○ | ○ | ○ | X | X |
| | 0.3 | ○ | ○ | ○ | X | X |
| | 0.8 | ○ | ○ | X | X | X |
| | 2.0 | ○ | X | X | X | X |

In Table 3, the mark "O" indicates the case where neither the wavy border line phenomenon nor the nonuniform thickness phenomenon was detected with the coating conditions varied within the ranges specified in Table 1, and the mark "X" indicates the case where the wavy border line phenomenon or nonuniform thickness phenomenon was detected with the coating conditions varied within the ranges specified in Table 1.

As is apparent from Table 2, in the case where the coated layer was formed with a coating head in which the radius of curvature of the inner edges of the coating width regulating boards was set to 0.5 mm or less, the wavy border line phenomenon and the nonuniform thickness phenomenon are substantially prevented.

As is seen from Table 3, it is not always necessary for the upstream edge of the coating width regulating board to meet the slot forming edge of the back edge end face. That is, if the coating head is designed so that the upstream edge of the coating width regulating board abuts the inner wall of the back edge at a distance from the slot forming edge which is about half the slot width or less, then an excellent coating can be formed which is free from the wavy border line phenomenon or the nonuniform thickness phenomenon along the two edges in the widthwise direction of the coated layer.

What is claimed is:

1. In an extrusion type coating apparatus for applying a coating solution to a flexible support, said coating apparatus comprising a coating head including an end face having a back edge end face and a doctor edge end face set close to a flexible support which is continuously run, and a pair of coating width regulating members made of a metallic material are arranged in a slot of said coating head at opposite ends of said slot so as to be disposed between opposite lateral end portions of said back edge end face and Said doctor edge end face, the improvement wherein:

an edge of each of said pair of coating width regulating members has a radius of curvature between 0.5 mm and 0.001 mm, and a downstream edge of an end face of each coating width regulating member is continuous with an upstream edge of said doctor edge end face, and an upstream edge of said end face of each coating width regulating member is abutted against an inner wall of said back edge end face with the distance between an edge of said back edge end face adjacent said slot and said upstream edge of said end face of said coating width regulating member being half or less of the width of said slot and wherein said end faces, including said lateral end portions, are smoothly continuous along an entire Width of said support.

2. The extrusion type coating apparatus of claim 1, wherein said metallic material is cemented carbide material.

* * * * *